US008479316B2

(12) United States Patent
Curran et al.

(10) Patent No.: US 8,479,316 B2
(45) Date of Patent: Jul. 9, 2013

(54) UPPER GARMENT HAVING A PRE-TENSIONED BAND AND METHOD FOR MAKING THE SAME

(75) Inventors: Peter Curran, Lafayette, CO (US); Cyndi Saggus, Westminster, CO (US)

(73) Assignee: DashAmerica, Inc., Lafayette, CO (US)

( * ) Notice: Subject to any disclaimer, the term of this patent is extended or adjusted under 35 U.S.C. 154(b) by 351 days.

(21) Appl. No.: 12/817,810

(22) Filed: Jun. 17, 2010

(65) Prior Publication Data

US 2010/0319101 A1 Dec. 23, 2010

Related U.S. Application Data

(60) Provisional application No. 61/218,026, filed on Jun. 17, 2009.

(51) Int. Cl.
*A41D 1/02* (2006.01)
*A41D 27/00* (2006.01)

(52) U.S. Cl.
USPC ..... 2/108; 2/98; 2/115; 2/123

(58) Field of Classification Search
USPC ..... 2/108, 93, 90, 85, 457, 123, 127, 2/243.1, 69, 455, 456, 458, 76, 97, 98, 106, 2/113, 115, 121, 125, 129, 135, 143, 270
See application file for complete search history.

(56) References Cited

U.S. PATENT DOCUMENTS

| | | | | | |
|---|---|---|---|---|---|
| 1,763,892 | A | * | 6/1930 | Knoernschild | 2/93 |
| 1,773,456 | A | * | 8/1930 | Good | 2/85 |
| 2,059,103 | A | | 10/1936 | Hardie et al. | |
| 2,255,823 | A | | 9/1941 | Abraham | |
| 3,560,292 | A | | 2/1971 | Butter | |
| 4,164,792 | A | | 8/1979 | Ito | |
| 4,782,534 | A | * | 11/1988 | Grilliot et al. | 2/81 |
| 5,119,510 | A | | 6/1992 | Schilling | |
| 5,586,339 | A | * | 12/1996 | Lathan | 2/46 |
| 5,625,899 | A | * | 5/1997 | Snedeker | 2/81 |
| 5,715,540 | A | | 2/1998 | Cho | |
| 5,802,609 | A | | 9/1998 | Garofalo | |
| 5,806,090 | A | * | 9/1998 | Johnson | 2/2.15 |
| 5,819,322 | A | | 10/1998 | Dicker et al. | |
| 5,960,474 | A | | 10/1999 | Dicker et al. | |
| 6,067,658 | A | | 5/2000 | Cho | |
| 6,089,421 | A | | 7/2000 | Cho | |
| 6,115,844 | A | | 9/2000 | Cho | |
| 6,119,273 | A | | 9/2000 | Cho | |
| 6,138,280 | A | | 10/2000 | Bae | |
| 6,286,144 | B1 | | 9/2001 | Henderson et al. | |
| 7,540,037 | B1 | | 6/2009 | Bittler et al. | |
| 2004/0006815 | A1 | * | 1/2004 | Carroll et al. | 2/457 |
| 2006/0218690 | A1 | | 10/2006 | James | |
| 2006/0277652 | A1 | | 12/2006 | Okajima | |
| 2006/0277653 | A1 | | 12/2006 | Okajima | |
| 2007/0271671 | A1 | | 11/2007 | Okajima | |
| 2009/0255031 | A1 | * | 10/2009 | McIntosh et al. | 2/87 |

OTHER PUBLICATIONS

International Search Report for International (PCT) Application No. PCT/US2010/039046, mailed Sep. 21, 2010.
Written Opinion for International (PCT) Application No. PCT/US2010/039046, mailed Sep. 21, 2010.
International Preliminary Report on Patentability for International (PCT) Application No. PCT/US2010/0039046 mailed Jan. 5, 2012, 8 pages.
Official Action for Canada Patent Application No. 2,765,303, dated Mar. 20, 2013 3 pages.

* cited by examiner

*Primary Examiner* — Amy Vanatta
(74) *Attorney, Agent, or Firm* — Sheridan Ross P.C.

(57) ABSTRACT

This invention generally relates to an upper garment. More specifically, the present invention relates to an upper garment having a pre-tensioned waistband.

15 Claims, 3 Drawing Sheets

Fig. 3
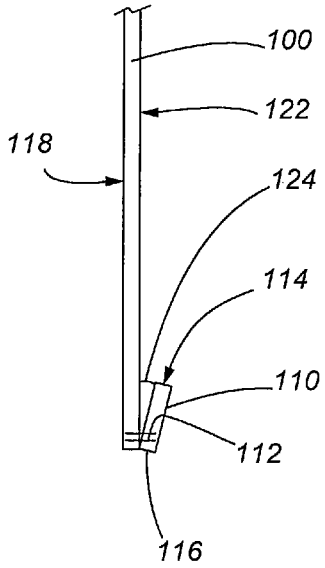
Fig. 6
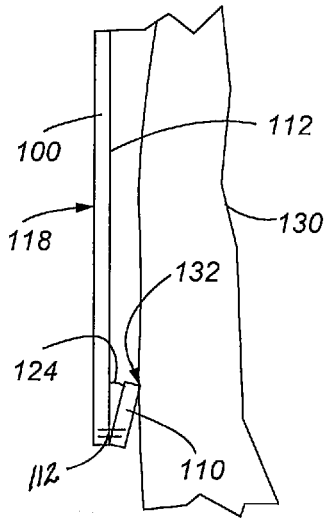
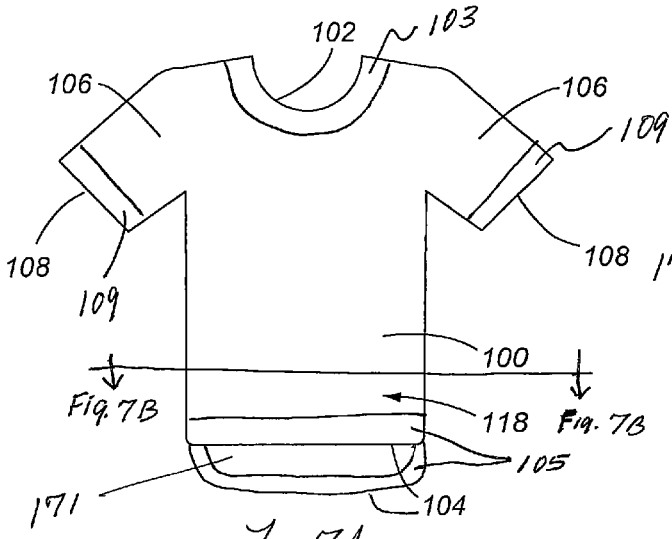
Fig. 7A
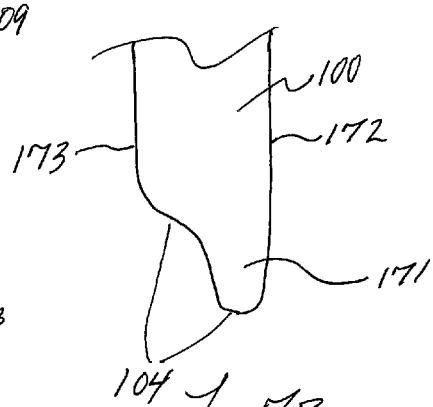
Fig. 7B

UPPER GARMENT HAVING A PRE-TENSIONED BAND AND METHOD FOR MAKING THE SAME

CROSS REFERENCE TO RELATED APPLICATIONS

The present application claims the benefit of U.S. Provisional Application No. 61/218,026 filed on Jun. 17, 2009, entitled "Pre-Tensioned Waistband", the entire contents of which are incorporated herein by this reference in its entirety.

FIELD OF INVENTION

This invention generally relates to an upper garment worn about a person's upper torso. More specifically, the present invention relates to an upper garment having a pre-tensioned waistband.

BACKGROUND OF THE INVENTION

Upper garments, such as jackets or jerseys, have waist and collar hems and, if the garment has sleeves, a pair of sleeve hems. Typically, the waist, collar and sleeve hems fit loosely about a person wearing the upper garment. The loose fitting hems allow for air to enter about the waist, collar and sleeves and to circulate between the garment and the wear's body. Such air circulation can provide comfort to the wearer in temperate or warm weather.

However, when the garment is worn during inclement weather, loose fitting hems that allow air to circulate between the garment and the wearer's body are undesirable. As such, upper garments designed for inclement weather typically have a fastening device, such as a drawstring, belt, button, or hook to pull and/or gather the hem onto itself and about the wearer. The pulling and gathering of the hem onto itself forms gaps and/or passages between the gathered hem and wearer. Warm air contained between the upper garment and wearer can escape through the passages and cold air can enter.

SUMMARY OF THE INVENTION

One embodiment of the present invention is a method for making an upper garment by: a) applying and maintaining a strain to an elastomeric band, the elastomeric band having opposing distal ends and opposing upper and lower edges; b) attaching the lower edge of the elastomeric band to an edge of an upper garment while substantially maintaining the strain on the elastomeric band; c) attaching the distal ends to at least one of each other or the upper garment; and d) removing the strain applied to the elastomeric band to form a pre-tensioned elastomeric band and a pre-tensioned upper garment edge. In preferred embodiment, the attaching in one or both of steps b) and c) is by at least one of stitching, welding, bonding or a combination thereof.

The upper garment has opposing inner and outer surfaces and the pre-tensioned elastomeric band is positioned adjacent to the inner surface. Preferably, the upper garment is one of a jacket or a jersey.

The edge of the upper garment is at least one of a waist edge, a cuff edge and a collar edge. More preferably, the pre-tensioned upper garment edge is substantially smooth and substantially free of gatherings and passages. Even more preferably, the upper and lower edges of the pre-tensioned elastomeric band have differing tensions.

In one embodiment, at least some portion of the top edge of the pre-tensioned elastomeric band is attached to the upper garment. Preferably, the top edge of the pre-tensioned elastomeric band is attached to the upper garment substantially about one or more locations where a seam of the upper garment intersects the pre-tensioned-elastomeric band. More preferably, when the pre-tensioned elastomeric band is positioned between the wearer and the upper garment, the pre-tensioned elastomeric band is sufficiently pre-tensioned to substantially form a seal between a wearer of the upper garment and the pre-tensioned band. Even more preferably, the seal substantially impedes air flow between the pre-tensioned band and the wearer.

Another embodiment of the present invention is an upper garment having a upper garment shell having opposing inner and outer surfaces, a waist edge, a collar edge and a pair of wrist cuff edges; and a first pre-tensioned elastomeric band having opposing upper and lower first edges and opposing first distal ends. The first pre-tensioned elastomeric band is positioned adjacent to the inner surface of the upper garment shell and is attached to one of the waist edge, collar edge and pair of wrist cuff edges to form a first pre-tensioned-upper garment. In a preferred embodiment, the first upper and lower edges of the first pre-tensioned elastomeric band have differing tensions. In a more preferred embodiment, at least some portion of the first top edge is attached to the upper garment shell. The upper garment can be a jacket or a jersey.

Preferably, the first pre-tensioned upper garment edge is the waist edge of the upper garment. More preferably, the pre-tensioned upper garment waist edge is substantially smooth and substantially free of gatherings and passages.

Preferably, the first distal ends are attached to at least one of each other and the upper garment shell. More preferably, one or both of the first distal ends and first lower edge are attached by one or more of stitching, welding, bonding and combinations thereof.

In one embodiment, the first top edge is attached to the upper garment shell substantially about one or more locations where an upper garment seam intersects the first pre-tensioned-elastomeric band.

In a preferred embodiment, the first pre-tensioned elastomeric band is sufficiently pre-tensioned to substantially form a seal between a wearer of the upper garment shell and the first pre-tensioned band when the first pre-tensioned elastomeric band is positioned between the wearer and the upper garment shell. In a more preferred embodiment, the seal substantially impedes air flow between the first pre-tensioned band and the wearer.

Optionally, the upper garment has a second pre-tensioned elastomeric band. The second pre-tensioned elastomeric band has opposing second upper and lower edges and opposing second distal ends. The second pre-tensioned elastomeric band is attached to one of the collar edge and pair of wrist cuff edges to from a second pre-tensioned-upper garment edge. The second pre-tensioned elastomeric band is positioned adjacent to the inner upper garment shell. The second distal ends are attached to at least one of each other and the upper garment shell. Preferably, one or both of the second distal ends and second lower edge are attached by one or more of stitching, welding, bonding and combinations thereof. Preferably, the first pre-tensioned elastomeric band is positioned adjacent to the waist edge of the upper garment shell.

In another optional embodiment, the upper garment has a third pre-tensioned elastomeric band having opposing third upper and lower edges and opposing third distal ends. Preferably, the first pre-tensioned elastomeric band is positioned adjacent to the waist edge of the upper garment shell, the second pre-tensioned elastomeric band is positioned adjacent to one of the collar edge and the pair of wrist cuff edges, and the third pre-tensioned elastomeric band is attached to the other of the collar edge and pair of wrist cuff edges to from a third pre-tensioned-upper garment edge. The third pre-tensioned elastomeric band is positioned adjacent to the inner upper garment shell. The third distal ends are attached to at least one of each other and the upper garment shell. Preferably, one or both of the third distal ends and third lower edge are attached by one or more of stitching, welding, bonding or combination thereof.

Yet another embodiment of the present invention is a jacket. The jacket has a jacket shell and a pre-tensioned elastomeric band. The jacket shell has opposing inner and outer surfaces, a waist edge, a collar edge and a pair of wrist cuff edges. The pre-tensioned elastomeric waist band has opposing upper and lower edges and opposing distal ends. The pre-tensioned elastomeric waist band is attached to the waist edge to form a substantially smooth pre-tensioned-jacket waist edge substantially devoid of valleys and ridges. Furthermore, the pre-tensioned elastomeric waist band is positioned adjacent to the inner jacket shell. The distal ends of the pre-tensioned elastomeric waist band are attached to at least one of each other and the jacket shell. The upper and lower edges of the pre-tensioned elastomeric waist band have differing tensions. Moreover, the pre-tensioned elastomeric band is sufficiently pre-tensioned to substantially form a seal between a wearer of the jacket and the pre-tensioned band when the pre-tensioned elastomeric band is positioned between the wearer and the jacket shell. Preferably, the seal substantially impedes air flow between the pre-tensioned waist band and the wearer.

In a preferred embodiment, the distal ends and lower edge of the pre-tensioned elastomeric waist band are attached by one or more of stitching, welding, bonding or a combination thereof. In a more preferred embodiment, at least some portion of the top edge of the pre-tensioned elastomeric waist band is attached to the jacket shell substantially about one or more locations where a jacket seam intersects the pre-tensioned elastomeric waist band.

These and other advantages will be apparent from the disclosure of the invention(s) contained herein.

As used herein, the term "a" or an entity refers to one or more of that entity. As such, the terms "a" (or "an"), one or more and at least one can be used interchangeably herein. It is also to be noted that the terms "comprising", "including", and "having" can be used interchangeably.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present invention(s). These drawings, together with the description, explain the principles of the invention(s). The drawings simply illustrate preferred and alternative examples of how the invention(s) can be made and used and are not to be construed as limiting the invention(s) to the illustrated and described below.

FIG. 3 depicts a cross-section view of the embodiment of FIG. 2;

FIG. 6 depicts a cross-sectional view of the upper garment of FIG. 2 in contact with a wearer;

FIG. 7A depicts an optional embodiment of FIG. 1; and

FIG. 7B depicts a side plane view of FIG. 7A with component 105 omitted for clarity.

Figure 1:
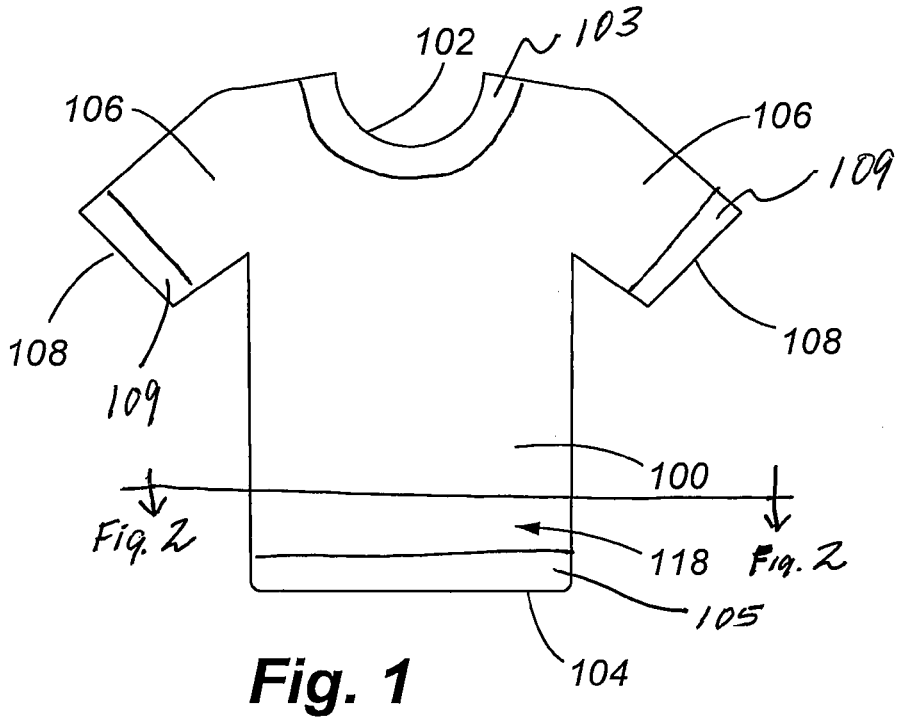
FIG. 1 depicts a plane view of an upper garment according to an embodiment of the present invention.

Further features and advantages will become apparent from the following, more detailed, description of the various embodiments of the invention(s), as illustrated by the drawings.

DETAILED DESCRIPTION OF THE INVENTION

The upper garment 100 depicted in FIGS. 1-4, 6 and 7A comprises a pair of sleeves 106 having sleeve edges 108, a collar edge 102, a waist edge 104, and opposing exterior 118 and interior 122 surfaces. In a less preferred embodiment, the pair of sleeves 106 is omitted. FIGS. 7A and 7B depict an embodiment where the upper garment 100 further comprises a tail 171 extending about back 172 of the upper garment 100. The back 172 is positioned about a wearer posterior side and front 173 about a wearer's anterior side. The front 173 and back 172 are in an opposing relationship.

The upper garment 100 can be any garment a person would wear on their upper torso between and about their shoulders and waist. The collar edge 102 is positioned about the wearer's neck region, the sleeves 106 about the wearer's arms and the waist edge 104 about the wearer's waist region. The sleeves 106 have a sleeve length. The sleeve length can vary. As such, the sleeve edge 108 may be positioned about one of the wearer's bicep, elbow, forearm or wrist regions. The upper garment 100 can comprise one of a jacket, a jersey, a shirt, a blouse, a vest, a coat, or a sweater. In a preferred embodiment the upper garment 100 is one of a jersey or a jacket. Preferably, the collar 102, waist 104 and sleeve 108 edges are hemmed.

The upper garment 100 has a pre-tensioned elastomeric band 111 about at least one of the collar 102, waist 104 and sleeve 108 edges. In a preferred embodiment, the upper garment 100 comprises a pre-tensioned elastomeric band 111 at least about the waist edge 104. When the upper garment 100 has a tail, the waist edge 104 extends about the tail 171.

The pre-tensioned elastomeric band 111 comprises an elastomeric band 110 having a residual tension. The elastomeric band 110 has opposing distal ends 120, opposing upper 114 and lower 116 edges, and an elastomeric band width 115.

Figure 5:
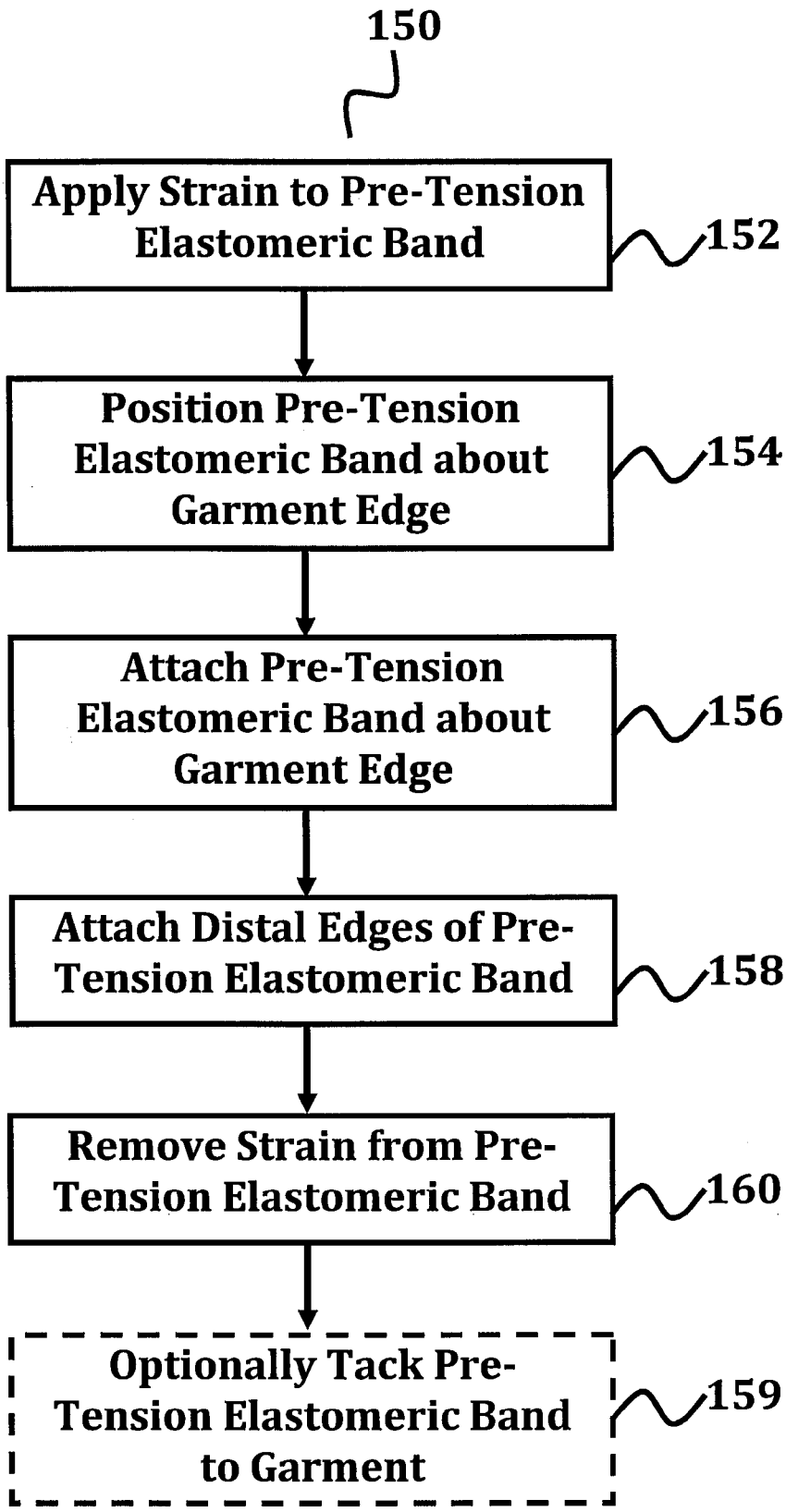
FIG. 5 depicts a process for making an upper garment according to yet another embodiment of the present invention.

Before describing the upper garment in more detail, a process 150 (FIG. 5) for making an upper garment having one or more pre-tensioned elastomeric bands will be described.

In step 152, a strain is applied to an elastomeric band. The strain can be applied mechanically by a machine, apparatus or device or manually by a human. The elastomeric band comprises one of a woven, non-woven, extruded and/or cast elastomeric material.

As used herein, the term "elastomeric material" includes a material that can be elongated when a strain is applied to elongate the material to at least about 1.25 times, at least about 2 times, at least about 3 times, at least about 4 times, at least about 5 times, at least about 6 times, at least about 7 times, at least about 8 times, at least about 9 times, or at least about 10 times its pre-strain length in at least one direction and return, when the strain is removed, to a post-strain length of no more than about 1.00 times, no more than about 1.005 times, no more than about 1.01 times, no more than about 1.02 times, no more than about 1.03 times, no more than about 1.04 times, or no more than about 1.05 times its pre-strain length.

In step 154, the elastomeric band is positioned on an interior surface of an upper garment substantially about one of a collar, waist, or one or both of the sleeve edges. The elastomeric band has opposing upper and lower edges and opposing distal ends. More specifically, a lower edge of the elastomeric band is positioned substantially about one of a collar, waist, or one or both of the sleeve edges. In one embodiment, steps 152 and 154 can be preformed substantially simultaneously. That is, the strain can be applied to the elastomeric band substantially during at least some, if not most or all, of the positioning of the elastomeric band on the interior surface about one of the collar, waist, or one or both of the sleeve edges. In another embodiment, step 152 can be preformed before or after step 154.

In step 156, while maintaining the applied strain to the elastomeric band, the elastomeric band is attached to the upper garment. The strain applied to the elastomeric band during the attachment of the elastomeric band to the upper garment, is sufficient to elongate the elastomeric band from about 1.01 to about 2.0 times its pre-strained length, from about 1.05 to about 1.75 times it pre-strained length, from about 1.05 to about 1.50 its pre-strained length, from about 1.05 to about 1.25 its pre-strained length, or from about 1.10 to about 1.25 its pre-strained length.

In a preferred embodiment, the lower edge of elastomeric band is attached substantially about one of the collar, waist, or one of the sleeve edges. The lower edge is attached to the upper garment by one or more of stitching, welding, bonding, such as, with an adhesive or a glue, or combinations thereof.

In a preferred embodiment, the lower edge is attached to the upper garment by stitching. In a more preferred embodiment, the stitching attaching the elastomeric band to the upper garment is contained within the elastomeric band width comprising one of no more than about 5% of the elastomeric band width about the lower edge, of no more than about 10% of the elastomeric band width about the lower edge, no more than about 15% of the elastomeric band width about the lower edge, or no more than about 20% of the elastomeric band width about the lower edge.

In step 158, the opposing distal ends of the elastomeric band are attached to one or both of the upper garment or each other. The distal ends are attached to the upper garment and/or each other by one or more of stitching, welding, bonding, such as with an adhesive or a glue, or combinations thereof. Preferably the distal ends are attached to each other and/or the upper garment by stitching.

In one embodiment, step 156 is preformed before or after step 158. In another embodiment, steps 156 and 158 are preformed substantially at about the same time.

In step 160, after attaching the elastomeric band to the upper garment, the strain applied to the elastomeric band is removed to form the pre-tensioned elastomeric band and one of a pre-tensioned collar band, a pre-tensioned waist-band or a pre-tensioned sleeve-band. While not wanting to be limited by any theory, the attaching of the lower edge of elastomeric band to the upper garment while the elastomeric band is under some degree of strain allows for the upper garment to maintain some degree of the strain (when the applied strain is removed) thereby forming the pre-tensioned elastomeric band. The pre-tensioned elastomeric band comprises upper and lower edges having differing tensions. The attaching of the lower edge, and not both the upper and lower edges, to the upper garment while the elastomeric band is under an applied strain, provides for differing tensions between the upper and lower edges when the applied strain is removed. The tension difference between the upper and lower edges depend upon one or more of: a) the strain applied to the elastomeric band during the attachment step 156; b) stiffness and/or tension retaining properties of the upper garment 100.

In a preferred embodiment, the strain applied to the elastomeric band during the attachment step 156 and the stiffness and/or tension retaining properties of the upper garment can be sufficiently balanced such that when the strain is removed in step 160, one of a formed pre-tensioned collar-band, pre-tensioned waist-band or pre-tensioned sleeve band is substantially free of any gathering of the collar, waist or sleeve edges onto itself. That is, one or more of the pre-tensioned collar-band, pre-tensioned waist-band and pre-tensioned sleeve-band are substantially free and/or devoid of gaps and/or passages between the respective pre-tensioned bands and a wearer of the upper garment to form a substantially air-tight seal between the wearer and the pre-tensioned band.

While not wanting to be limited by theory, the air-tight seal between wearer and pre-tensioned band is believed to be enhanced by eliminating at least most, if not all, of any attachment of the upper edge of the elastomeric band to the upper garment. Preferably, at least about 90% of upper portion of the elastomeric band width is devoid any attachment to the upper garment, at least about 95% of the upper portion of the elastomeric band width is devoid of any attachment to the upper garment, at least about 99.99% of upper portion of the elastomeric band width is devoid of any attachment to the upper garment, at least about 100% of upper portion of the elastomeric band width is devoid of any attachment to the upper garment.

It is further believed that one or both of the differing tensions of the upper and lower edges of elastomeric band and lack of attaching the upper edge of the elastomeric band to the upper garment causes the upper edge to tilt away from the upper garment. The upper edge tilts away from the upper garment by tilt angle. The tilt angle has an angle from about 5 degrees to about 45 degrees, from about 10 degrees to about 40 degrees, from about 10 to about 30 degrees, from about 10 to about 20 degrees. In another embodiment, the tilt angle has an angle from about 15 to about 40 degrees or from about 15 to about 30 degrees.

The process 150 can further comprise optional step 159. In the optional step 159, one or more locations about the upper edge of the elastomeric band are attached to the upper garment. The one or more locations are attached to the upper garment by one or more of stitching, welding, bonding, such as, with an adhesive or a glue, or combinations thereof. Preferably, the one or more locations are substantially located about where the pre-tensioned elastomeric band intersects a seam within the upper garment. More preferably, the upper edge is attached to the upper garment by stitching the upper edge to the upper garment about where the pre-tensioned elastomeric band intersects one of the seams. More preferably, the number of locations where the upper edge is attached to the upper garment is one of less than about 13, less than about 12, less than about 11, less than about 10, less than about 9, less than about 8, less than about 7, less than about 6, less than about 5, less than about 4, less than about 3, less than about 2, or less than about 1.

In one embodiment, the optional step 159 is preformed one of before or after any one or both of steps 156 and 158. In another embodiment, optional step 159 is preformed one of before or after step 160.

Figure 2:
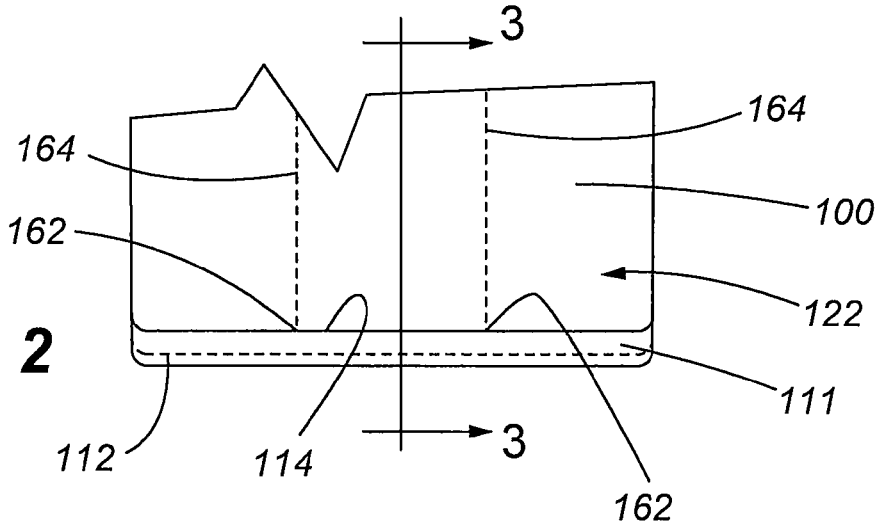
FIG. 2 depicts a plane view of a hem of the upper garment according to the embodiment of FIG. 1.
Figure 4:
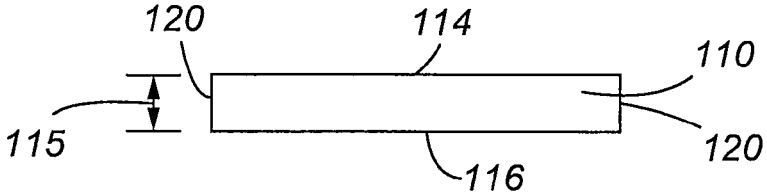
FIG. 4 depicts a plane view of the elastomeric-band according to the embodiments of FIGS. 1, 2, 3 and 5.

Referring to the embodiment shown in FIG. 6, the upper garment 100 comprises one or more of a substantially air-tight seal 132 about one or more of the pre-tensioned collar band 103, pre-tensioned waist band 105 and pre-tensioned sleeve band 109. While not wanting to be limited by example, FIGS. 2, 3 and 6 depict the pre-tension band 111 attached to the upper garment 100 by stitching 112. The one or more air-tight seals 132 substantially retain any warm air contained between the upper garment 100 and wearer. Furthermore, the substantially air-tight seal 132 substantially eliminates any cold air from entering and thereby lowering the temperature of the warm air contained between the upper garment 100 and the wearer.

In a preferred embodiment, the air-tight seal 132 formed by the pre-tensioned elastomeric band 111 is substantially devoid of any gatherings and/or passages about one or more of the respective pre-tensioned collar 103, waist 105, and sleeve 109 bands. The lack of gatherings and/or passages substantially decreases any warm air contained between the upper garment 100 and wearer from escaping and any cold air from entering.

Furthermore, the lack of any gatherings and passages provides for a more aesthetically pleasing, cleaner, and crisper-looking upper garment 100. Moreover, the lack of a tight, rigid fastening system allows for a less constrictive upper garment 100. The less constrictive upper garment 100 is a substantially more dynamic garment and allows the wearer to participate in activities in a more dynamic and enjoyable manner.

A number of variations and modifications of the invention can be used. It would be possible to provide for some features of the invention without providing others. For example, the upper garment 100 may comprise a pre-tensioned collar band 103, a pre-tensioned waistband 105 and a pair of pre-tensioned sleeve bands 109. In another embodiment, the upper garment 100 comprises a pre-tensioned collar band 103 a pre-tensioned waistband 105 or a combination thereof.

The present invention, in various embodiments, configurations, or aspects, includes components, methods, processes, systems and/or apparatus substantially as depicted and described herein, including various embodiments, configurations, aspects, sub-combinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, reducing cost of implementation or combinations thereof.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

What is claimed is:

1. An upper garment, comprising:

a upper garment shell having opposing inner and outer surfaces, a waist edge, a collar edge and a pair of wrist cuff edges; and a first pre-tensioned elastomeric band having opposing upper and lower first edges and opposing first distal ends, wherein the first lower edge is attached to the waist edge to form a first pre-tensioned-upper garment edge and wherein the upper edge is positioned adjacent to and tilted away from the inner surface of the upper garment shell.

2. The upper garment of claim 1, wherein the first distal ends are attached to at least one of each other and the upper garment shell and wherein one or both of the first distal ends and first lower edge are attached by one or more of stitching, welding, bonding, or combinations thereof.

3. The upper garment of claim 1, wherein the first upper and lower edges have differing tensions.

4. The upper garment of claim 1, wherein at least some portion of the first upper edge is attached to the upper garment shell.

5. The upper garment of claim 4, wherein the first upper edge is attached to the upper garment shell substantially about one or more locations where an upper garment seam intersects the first pre-tensioned-elastomeric band.

6. The upper garment of claim 1, wherein the first pre-tensioned elastomeric band is sufficiently pre-tensioned to substantially form a seal between a wearer of the upper garment shell and the first pre-tensioned band when the first pre-tensioned elastomeric band is positioned between the wearer and the upper garment shell.

7. The upper garment of claim 6, wherein the seal substantially impedes air flow between the first pre-tensioned band and the wearer.

8. The upper garment of claim 1, wherein the upper garment comprises one of a jacket or a jersey.

9. The upper garment of claim 1, wherein the first pre-tensioned upper garment edge comprises the waist edge.

10. The upper garment of claim 9, wherein the pre-tensioned upper garment waist edge is substantially smooth and substantially free of gatherings and passages.

11. The upper garment of claim 9, wherein the upper garment further comprises a second pre-tensioned elastomeric band having opposing second upper and lower edges and opposing second distal ends, wherein the second pre-tensioned elastomeric band is attached to one of the collar edge and pair of wrist cuff edges to from a second pre-tensioned-upper garment edge and wherein the second pre-tensioned elastomeric band is positioned adjacent to the inner surface of the upper garment shell, wherein the second distal ends are attached to at least one of each other and the upper garment shell and wherein one or both of the second distal ends and second lower edge are attached by one or more of stitching, welding, bonding or combinations thereof.

12. The upper garment of claim 11, wherein the upper garment further comprises a third pre-tensioned elastomeric band having opposing third upper and lower edges and opposing third distal ends, wherein the third pre-tensioned elastomeric band is attached to the other of the collar edge and pair of wrist cuff edges to from a third pre-tensioned-upper garment edge and wherein the third pre-tensioned elastomeric band is positioned adjacent to the inner surface of the upper garment shell, wherein the third distal ends are attached to at least one of each other and the upper garment shell and wherein one or both of the third distal ends and third lower edge are attached by one or more of stitching, welding, bonding or combinations thereof.

13. A jacket, comprising:

a jacket shell having opposing inner and outer surfaces, a waist edge, a collar edge and a pair of wrist cuff edges; and a pre-tensioned elastomeric waist band having opposing upper and lower edges and opposing distal ends, wherein the lower edge is attached to the waist edge to form a substantially smooth pre-tensioned-jacket waist edge substantially devoid of valleys and ridges, wherein the pre-tensioned elastomeric waist band is positioned adjacent to the inner surface of the jacket shell, wherein the distal ends of the pre-tensioned elastomeric waist band are attached to at least one of each other and the jacket shell, wherein the upper and lower edges of the pre-tensioned elastomeric waist band have differing tensions and wherein the pre-tensioned elastomeric band is sufficiently pre-tensioned to substantially form a seal between a wearer of the jacket and the pre-tensioned band when the pre-tensioned elastomeric band is positioned between the wearer and the jacket shell.

14. The jacket of claim 13, wherein one or both of the distal ends and lower edge are attached by one or more of stitching, welding, bonding or combinations thereof and wherein the seal substantially impedes air flow between the pre-tensioned waist band and the wearer.

15. The jacket of claim 13, wherein at least some portion of the upper edge of the pre-tensioned elastomeric waist band is attached to the jacket shell substantially about one or more locations where a jacket seam intersects the pre-tensioned elastomeric waist band.

* * * * *